United States Patent [19]

Rose

[11] Patent Number: 4,841,305

[45] Date of Patent: Jun. 20, 1989

[54] METHOD OF SECTIONING AN ANTENNAE REFLECTOR

[75] Inventor: Mark W. Rose, Fort Worth, Tex.

[73] Assignee: Dalsat, Inc., Plano, Tex.

[21] Appl. No.: 151,000

[22] Filed: Feb. 1, 1988

[51] Int. Cl.[4] ..... H01Q 15/16

[52] U.S. Cl. ..... 343/912; 343/915

[58] Field of Search ..... 343/781 P, 781 CA, 781 R, 343/878, 881, 890, 912, 915

[56] References Cited

U.S. PATENT DOCUMENTS

| | | | |
|---|---|---|---|
| 3,971,023 | 7/1976 | Taggart | 343/840 |
| 3,978,490 | 8/1976 | Fletcher et al. | 343/882 |
| 4,030,103 | 6/1977 | Campbell | 343/915 |
| 4,201,991 | 5/1980 | Vines | 343/840 |
| 4,314,253 | 2/1982 | Sayovitz | 343/765 |
| 4,315,265 | 2/1982 | Palmer et al. | 343/840 |
| 4,352,113 | 9/1982 | Labruyere | 343/915 |
| 4,506,271 | 3/1985 | Gonzalez | 343/915 |
| 4,511,901 | 4/1985 | Westphal | 343/915 |
| 4,527,166 | 7/1985 | Luly | 343/840 |
| 4,529,277 | 7/1985 | Gee et al. | 350/613 |
| 4,608,571 | 8/1986 | Luly | 343/781 P |
| 4,613,870 | 9/1986 | Stonier | 343/915 |
| 4,642,652 | 2/1987 | Herbig et al. | 343/915 |
| 4,646,102 | 2/1987 | Akaeda et al. | 343/915 |
| 4,654,671 | 3/1987 | Baghdasarian | 343/915 |
| 4,683,475 | 7/1987 | Luly | 343/915 |

FOREIGN PATENT DOCUMENTS

| | | | |
|---|---|---|---|
| 0072305 | 4/1985 | Japan | 343/915 |

*Primary Examiner*—William L. Sikes
*Assistant Examiner*—Doris J. Johnson
*Attorney, Agent, or Firm*—W. Kirk McCord

[57] ABSTRACT

A method of sectioning an antennae reflector without distorting the shape of the reflector surface. The reflector is supported in a substantially relaxed state so that only its internal residual stresses determine its shape. A plurality of beam pairs are attached to the outer surface of the reflector and are used to mark the corresponding curves along which the reflector is to be sectioned. When the cut lines have been marked so as to be visible on the inner surface of the reflector, the reflector is then cut along the cut lines marked on the inner surface thereof to section the antennae for transport and storage.

17 Claims, 3 Drawing Sheets

SECTION A-A

SECTION B-B

METHOD OF SECTIONING AN ANTENNAE REFLECTOR

FIELD OF THE INVENTION

The present invention relates to parabolic reflectors used in telecommunications and in particular to parabolic reflectors which are at least partially collapsible so as to facilitate transport and storage thereof.

BACKGROUND OF THE INVENTION

In telecommunications applications, and particularly in satellite communications, an antennae reflector is normally used to gather and focus the electromagnetic radiation being emitted from the spacecraft to earth. Furthermore, the same reflectors are used to transmit electromagnetic radiation back into space.

Reflectors having a diameter greater than three meters are usually too large to be carried efficiently on mobile equipment. Therefore, such reflectors are typically sectioned to allow them to be collapsed or folded for transport on public roads. During the process of sectioning the reflector, a substantial amount of surface quality is lost, resulting in a less efficient reflector. This loss of surface quality is particularly critical in view of the ever-decreasing orbital spacing between satellites. Presently, the spacing between adjacent satellites may be as little as two degrees azimuthally. Therefore, any loss in the directional capability of the antennae reflector cannot be tolerated. Recent Notices of Inquiry and Proposed Rulemaking (FCC Docket No. 81-204) by the Federal Communications Commission have rendered these variations in surface quality unacceptable.

The ability of a parabolic reflector to meet the standards of the Federal Communications Commission is based upon the shape of the reflector conforming to an exact mathematical equation. The manufacturing processes and the forces involved in producing this shape from a metal sheet result in variations and discontinuities in the resultant surface from the shape desired. Inspection of the surface and testing of the reflector is used to determine its suitability to meet applicable performance standards. The reflector should have the ability to absorb residual stresses inherent in the manufacturing process so that the resultant strain and distortion in the surface does not appreciably affect its efficiency and performance.

DESCRIPTION OF THE PRIOR ART

Two basic procedures are known in the art for manufacturing parabolic reflectors. The first procedure uses a vacuum mechanism to pull down pre-cut, pie-shaped "petals", which are then bonded and riveted to channel section beams shaped to conform to the desired shape of the reflector surface. The resulting panel conforms to the shape of the vacuum surface on which it was held. These multiple petals are then assembled to form the antennae reflector.

The second process involves cutting sections from an already manufactured reflector and disposing the sections upon vacuum tables with their edges exposed for riveting. Angle brackets are then riveted to the reflector and a flat plate, which holds the surface of the reflector to the desired shape. The sections are then assembled to form the reflector.

A major problem associated with the aforementioned prior art processes is that the residual stresses inherent in the material will produce discontinuities in the reflective surface as a result of the sectioning procedure. Such discontinuities will prevent the resulting antennae reflector from meeting the most stringent performance standards.

SUMMARY OF THE INVENTION

These and other objects are accomplished in accordance with the present invention wherein a method is provided for sectioning an antennae reflector to provide N number of sections. A substantially rigid antennae reflector having a curved inner surface for reflecting and focusing electromagnetic energy and a curved outer surface opposite from the inner surface is supported in a substantially relaxed state so that only its internal stresses determine its shape. N number of curves corresponding to the N number of sections to be formed are identified on one of the surfaces of the reflector and the reflector is sectioned along the curves to define the corresponding sections.

In one embodiment, 2N number of elongated beams, each of which has relatively flat opposite major surfaces and a minor surface which is curved to conform to the curvature of the outer surface, where N is an integer corresponding to the number of foldable sections to be formed from the reflector, are divided into N number of cooperating pairs and disposed in respective predetermined positions relative to the outer surface so that respective major surfaces of the beams of each cooperating pair are in facing relationship and the intersection of a plane lying between the facing major surfaces with the outer surface defines a corresponding curve along which the reflector is to be sectioned. The corresponding curves are identified and the beams of each cooperating pair are connected. Each beam pair is secured to the outer surface of the reflector so that a spacing is maintained between the respective curved minor surfaces of the beams and the outer surface. The reflector is sectioned along each of the corresponding curves to form N number of sections.

In another embodiment the step of supporting the reflector in a relaxed state includes the sub-steps of disposing a plurality of support members at predetermined intervals along the circumference of a circle of predetermined diameter, placing the reflector with its inner surface face down so that the weight of the reflector is substantially evenly distributed around the perimeter of the reflector, and securing the reflector against vertical and horizontal movement.

In yet another embodiment the step of connecting the individual beams of each cooperating pair includes hingedly attaching the individual beams so that the beams of each cooperating pair are pivotally moveable with respect to one another. The hinged attachment between individual beams in each cooperating pair allows the corresponding section to be folded relative to the remainder of the reflector. One of the beams in each cooperating pair is attached to the corresponding foldable section, while the other beam is attached to the remainder of the reflector.

In still another embodiment the step of marking the corresponding curves includes the sub-steps of drilling relatively small holes through the reflector, starting at the outer surface and terminating at the inner surface at predetermined intervals along the corresponding curves and drawing connecting lines between adjacent holes on the inner surface to define a series of cutting lines on the inner surface of the reflector.

In another embodiment the step of securing each beam pair to the outer surface of the reflector is comprised of the sub-steps of: providing a plurality of brace members, each of which is comprised of first and second relatively flat plates disposed at a predetermined angle so that the first plate can be placed in facing contact with a major surface of a corresponding beam pair and the second plate can be placed in tangential contact with the outer surface of the reflector adjacent to the corresponding beam pair; arranging the brace members at predetermined intervals along substantially the entire length of each beam pair so that the respective first plates are in facing contact with non-facing major surfaces on opposite sides of each beam pair and the respective second plates are in tangential contact with the outer surface; and securing the brace members so that the respective first plates are attached to the non-facing major surfaces of each beam pair on each side thereof and the respective second plates are attached to the outer surface of the reflector.

BRIEF DESCRIPTION OF THE DRAWINGS

Objects and advantages of the invention will be apparent from the detailed description and claims when read in conjunction with the accompanying drawings where:

DETAILED DESCRIPTION OF THE PREFERRED EMBODIMENT

In the description which follows, like parts are marked throughout the specification and drawings, respectively. The drawings are not necessarily to scale and in some instances proportions have been exaggerated in order to more clearly depict certain features of the invention.

Figure 1:
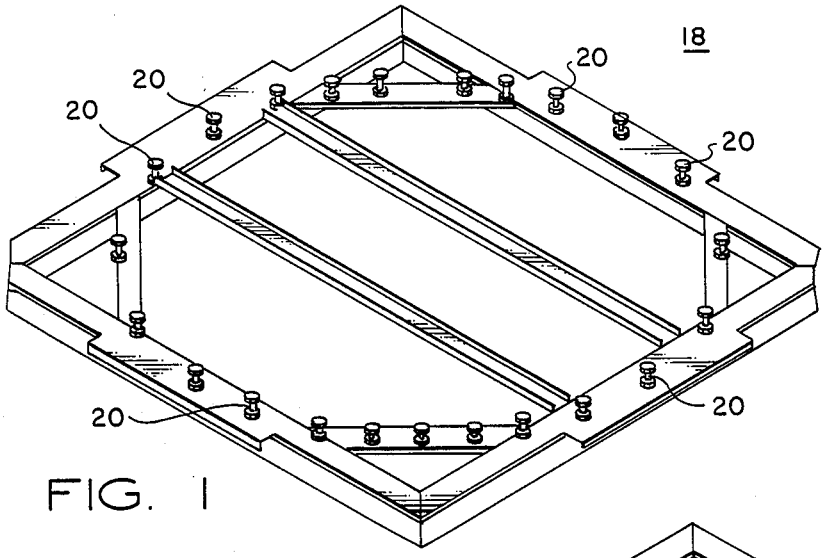
FIG. 1 is a perspective view of an assembly used to support an antennae reflector during the process of attaching beams to the reflector to provide a foldable reflector assembly.
Figure 2:
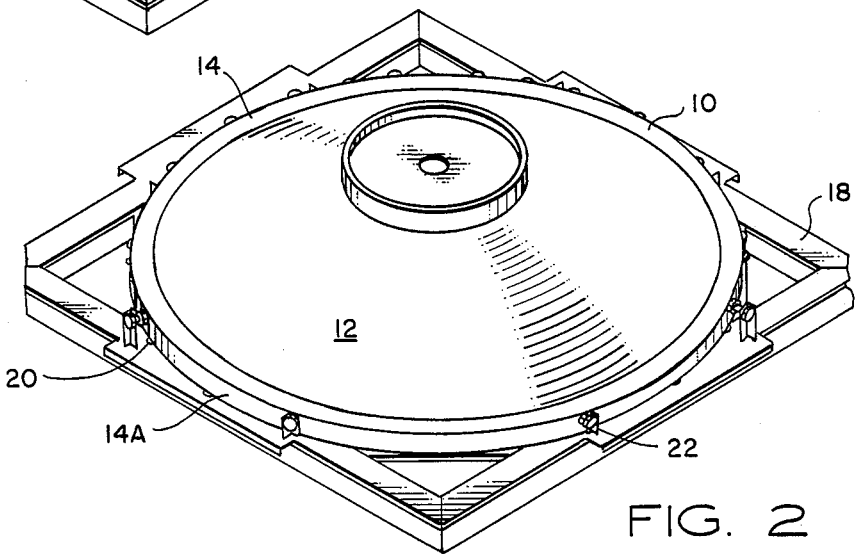
FIG. 2 is a perspective view of the antennae reflector being supported by the assembly depicted in FIG. 1, with the inner surface of the reflector face down.

Referring to FIGS. 1 and 2, a substantially rigid antennae reflector 10 is comprised of a curved inner surface (not shown) for reflecting and focusing incoming and outgoing electromagnetic energy, a curved outer surface 12 opposite from the inner surface and a relatively flat lip member 14 extending outwardly from the respective outer edges of the inner surface and outer surface 12 around the perimeter of reflector 10. The curvature of both the inner surface and outer surface 12 defines a predetermined parabolic curve from geometric center 16 of reflector 10 to any point on the respective outer edges of the inner and outer surfaces of reflector 10. The respective outer edges of the inner and outer surfaces of reflector 10 have a substantially circular shape and define the intersection between lip member 14 and the respective curved inner and outer surfaces of reflector 10.

Referring specifically to FIG. 1, a support assembly 18 includes a plurality of vertically oriented support members 20, which are preferably arranged along the circumference of a circle of predetermined diameter. The diameter of the circle in which support member 20 are arranged is a function of the size of the particular reflector 10 which is being supported by assembly 18. Referring again to FIG. 2, reflector 10 is positioned with its inner surface face down and lip member 14 resting on support members 20 so that the weight of reflector 10 is substantially evenly distributed around the perimeter thereof and the point loading is on lip member 14 rather than on the curved inner and outer surfaces of reflector 10. The vertical height of support members 20 is adjustable as needed. A plurality of radially directed anchoring members 22 are arranged around the perimeter of lip member 14 so as to be in contact with vertical portion 14A of lip member 14 to prevent reflector 10 from moving horizontally. Similarly, a plurality of clamping devices (not shown) are disposed around the perimeter of lip member 14 to restrain the vertical movement of reflector 10. Anchoring members 22 and the clamping devices are both adjustable as needed in accordance with the size and geometry of the particular reflector 10.

Figure 3:
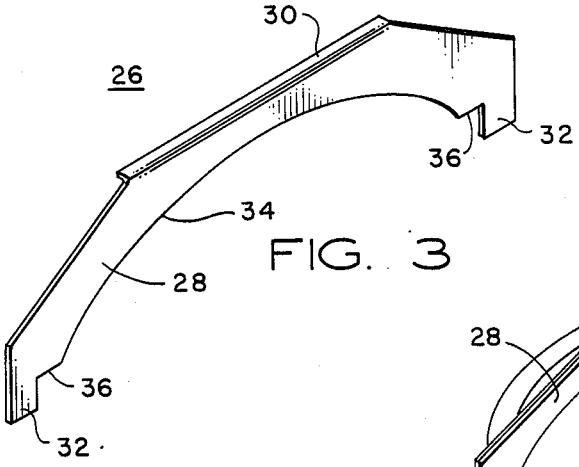
FIG. 3 is a perspective view of a beam which is used to define a corresponding curve along which the antennae reflector is to be sectioned.

Referring to FIG. 3, an elongated beam 26 is cut from a suitable metal, such as aluminum plate, to conform to the curvature of outer surface 12 on reflector 10. Beam 26 is comprised of relatively flat opposite major surfaces 28 (only one of which is shown in FIG. 3) and a relatively flat thin flange 30 extending from the central portion of beam 26. Beam 26 includes relatively flat first and second extension portions 32 disposed at respective distal ends of beam 26. A portion of beam 26 is cut to define a relatively thin curved minor surface 34. The curvature of minor surface 34 substantially conforms to the curvature of outer surface 12 and is used to define the corresponding curve along which reflector 10 is to be sectioned. Disposed at respective opposite ends of curved minor surface 34 are first and second relatively flat minor surfaces 36.

Figure 4:
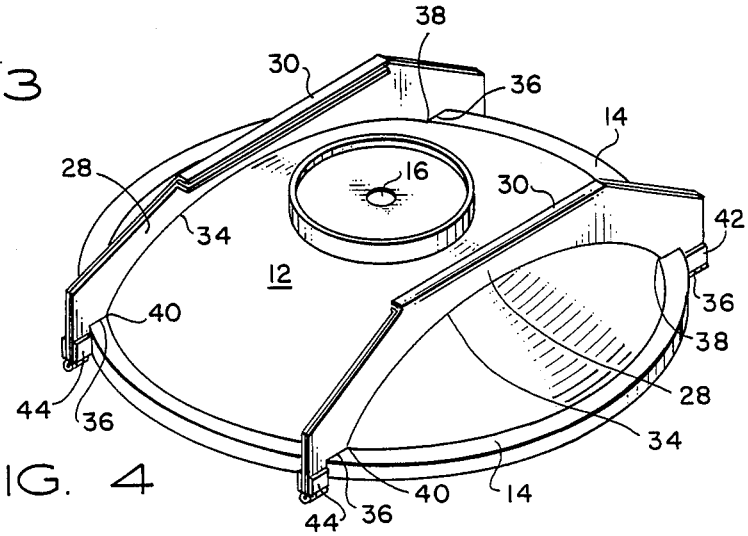
FIG. 4 is a perspective view of the antennae reflector with its inner surface face down and two beam pairs positioned for defining two corresponding curves along which the reflector is to be sectioned.

Referring also to FIG. 4, beam 26 is sized so that one or more beams 26 can be positioned on reflector 10 so that curved minor surface 34 is in facing relationship with outer surface 12 directly above the corresponding curves along which reflector 10 is to be sectioned. Curved minor surface 34 preferably extends from a first position 38 at or adjacent to the intersection of outer surface 12 with lip member 14, across outer surface 12, to a second position 40, which is also at or adjacent to the intersection of outer surface 12 with lip member 14. When beams 26 are positioned as shown in FIG. 4, first and second relatively flat minor surfaces 36 are resting on lip member 14 adjacent to respective first and second positions 38 and 40 and first and second extension portions 32 overlap respective edges of lip member 14. A relatively small spacing, on the order of $\frac{5}{8}$ to $\frac{1}{4}$ inch, is maintained between outer surface 12 and curved minor surface 34 to prevent any point loading upon outer surface 12, which can lead to distortion of the reflector surface.

Beams 26 are arranged in cooperating pairs and positioned so that respective major surfaces 28 of the individual beams 26 are in abutment and flange 30 of one of the beams overlaps the corresponding flange 30 of the other beam in each cooperating pair. The respective abutting first extension portions 32 of each cooperative beam pair are hingedly attached to provide a first hinged connection 42 and the respective abutting second extension portions 32 of each cooperating beam pair are hingedly attached to define a second hinged connection 44. In lieu of the hinged attachments, the abutting extension portions can be pinned so that the resultant reflector sections can be removed by removing the pins. The number of beam pairs corresponds to the number of foldable sections to be formed from reflector 10, so that the total number of beams 26 is equal to twice the number of foldable sections to be formed. In the drawings and hereinafter in the detailed description of the preferred embodiment, two beam pairs will be used as an example. One skilled in the art will appreciate that any number of foldable sections as desired can be formed in accordance with the present invention.

One skilled in the art will appreciate that the intersection of the plane lying between the abutting major surfaces 28 of each cooperative beam pair with outer surface 12 defines a corresponding curve along which reflector 10 is to be sectioned. With the beam pairs in place, this intersection is carefully marked on outer surface 12 and the beam pairs are removed to allow small holes, on the order of 1/32 inch in diameter, to be drilled through reflector 10 from outer surface 12 to the inner surface thereof. These holes are drilled at intervals of approximately 8 inches along the desired cutting curve and are used to identify the desired cutting curve on the inner surface of reflector 10, as will be described in greater detail with reference to FIG. 8. The holes extend substantially completely across outer surface 12 from first position 38 to second position 40. The size of the holes is such that their effect is negligible upon the residual stresses and resultant strain on reflector 10.

After the aforementioned holes are drilled, the beam pairs are repositioned as shown in FIG. 4 so that the plane between the abutting major surfaces of each beam pair is aligned with the corresponding cutting curve. Each beam pair is held in position by stationary supports (not shown) directly above reflector 10 and by clamping devices (not shown).

Figure 5:
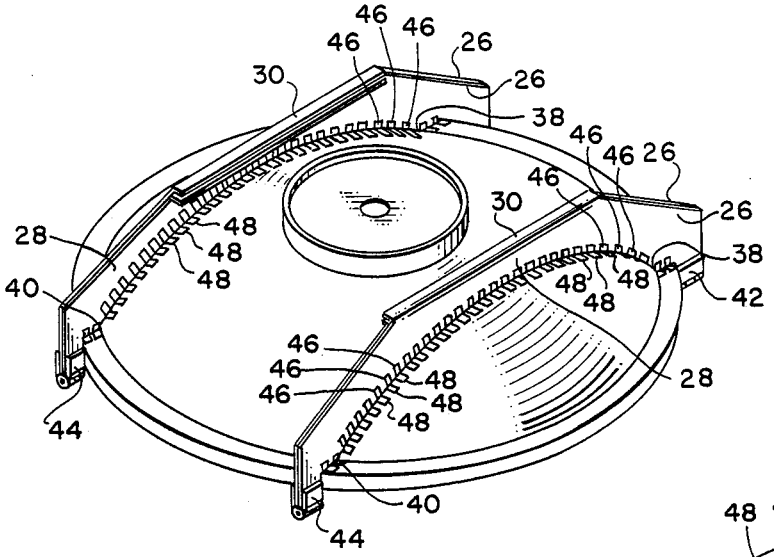
FIG. 5 is a perspective view similar to that shown in FIG. 4, showing a plurality of brace members attached to the beam pairs and outer surface of the antennae reflector for attaching the beam pairs to the outer surface.

Referring to FIG. 5, a plurality of substantially L-shaped braces are positioned at predetermined intervals along the corresponding cutting curves on both sides of each beam pair. Each brace is preferably comprised of first and second relatively flat metal plates 46 and 48, which are disposed at a predetermined angle such that first plate 46 can be placed in facing contact with the corresponding major surface 28 of the beam pair and second plate 48 can be placed in tangential contact with outer surface 12 adjacent to the corresponding beam pair. The braces are preferably formed from relatively thin (on the order of $\frac{3}{8}$ inch) aluminum plates of approximately two inches in width and four inches in length. The predetermined angle at which first and second plates 46 and 48 of each brace are disposed depends upon the corresponding position at which that particular brace is to be secured. The predetermined angle will be equal to the angle at which a line tangent to outer surface 12 at the position of that particular brace intersects major surface 28 of the corresponding beam pair. The braces are sufficiently pliable to allow the angle between the respective first and second plates 46 and 48 to be adjusted as required to conform to the aforementioned angle for each brace. The braces are preferably placed with their centers approximately three inches apart along the corresponding cutting curve on both sides of each beam pair and additional braces are positioned so that respective first plates 46 thereof are in contact with the corresponding major surface 28 and respective second plates thereof are in contact with lip member 14 on both sides of each beam pair, adjacent to first and second positions 38 and 40.

The braces are then removed and prepared for binding with an adhesive. The contact surfaces are lightly sanded with 400 grit sandpaper to remove any surface oxide which is present. Contact surfaces are then cleaned with Methyl Ethyl Ketone and allowed to dry. A batch of adhesive having sufficient physical properties to transfer all loads is mixed to be used in bonding the braces to outer surface 12 and beams 26. One suitable type of adhesive uses Ancamide 501 (35% by weight) as the epoxy catalyst, Epon 828 (100% by weight) as the epoxy resin and Aerosil 200 (0.8% by weight) as the filler or thickener. The adhesive is mixed so that its consistency is such that it will not run and may be applied in paste form.

The adhesive material is applied to the contact surfaces of the braces and the braces are pasted to outer surface 12 and non-abutting major surfaces 28 of each beam pair. It is important that the adhesive cover all of the contact surfaces with no voids or discontinuities and must fill the space between the flat contact surface of each second plate 48 and parabolic outer surface 12. The adhesive is allowed to cure in order to secure the connection.

Figure 6:
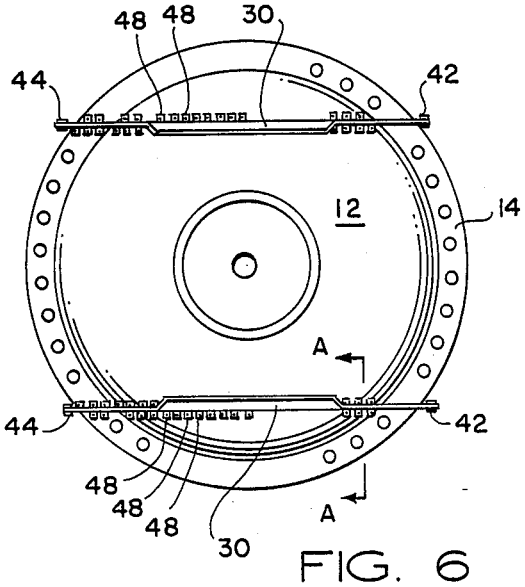
FIG. 6 is a top plan view of the configuration described above with reference to FIG. 5.
Figure 7:
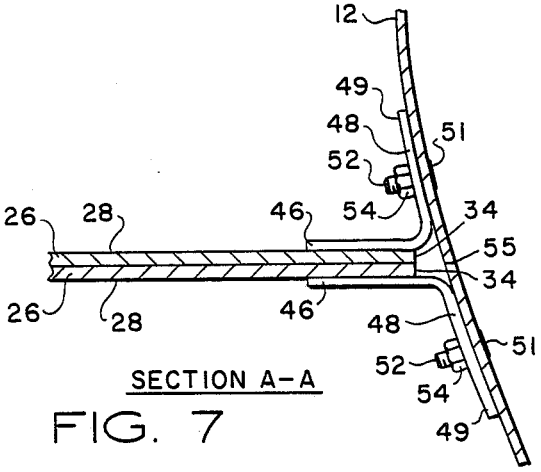
FIG. 7 is a sectional view, taken along the line A—A in FIG. 6, showing the attachment of the brace members to the reflector.

Referring to FIGS. 6 and 7, holes having a diameter of approximately 0.213 inch are drilled through the respective centers of respective second plates 48 in each brace, beginning on non-contact surface 49 of respective second plates 48. The holes are drilled through respective second plates 48 of all the braces and through reflector 10 so that the holes are visible from inner surface 50 of reflector 10. The holes are then countersunk with a 100 degree, 0.385 inch diameter countersink, as indicated at 51, and a 100 degree flat head stainless steel 10–32 UNF by 0.75 length screw 52 is installed from inner surface 50. A 10–32 UNF nylock stainless steel nut 54 is used to secure screw 52 on non-contact surface 49. A relatively small spacing 55 is maintained between respective curved minor surfaces 34 of beams 26 and outer surface 12.

After respective second plates 48 have been secured to reflector 10 as described above, the assembly is inverted so that inner surface 50 faces upward. The weight of reflector 10 is transmitted through lip member 14 to respective first and second relatively flat minor surfaces 36 of beams 26 so that reflector 10 is in a relaxed state with only the residual stresses of the material acting on curved inner and outer surfaces 50 and 12.

Figure 8:
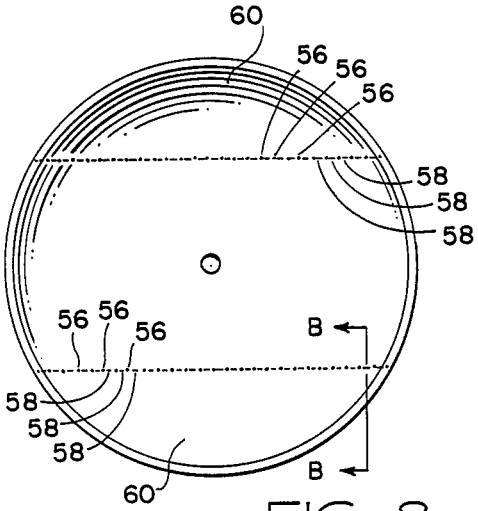
FIG. 8 is a top plan view of the inner surface of the reflector showing the two corresponding curves along which the reflector is to be sectioned.

Referring to FIG. 8, holes 56, which were previously drilled at predetermined intervals along the corresponding cutting curves as described above, are connected to provide a series of cutting segments 58. Reflector 10 is cut along corresponding cutting segments 58 beginning on inner surface 50 and continuing through the entire thickness of reflector 10 to outer surface 12 to define foldable sections 60. In FIG. 8, two foldable sections 60 are depicted, as evidenced by the corresponding two cutting curves. The abutting major surfaces of each beam pair can now be exposed by folding sections 60 so that one of the beams 26 in each beam pair pivots relative to the other beam 26.

Figure 9:
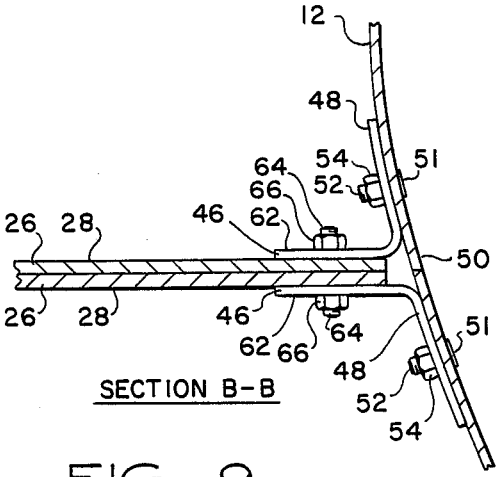
FIG. 9 is a sectional view, taken along the line B—B, showing the attachment of the brace members to the corresponding beam pair after sectioning.

Referring to FIG. 9, a hole having a diameter of approximately 0.213 inch is drilled through the approximate center of first plate 46 of each brace beginning on noncontact surface 62 of each first plate 46, which results in a hole which is visible and accessible from the cutting plane between the abutting major surfaces of each beam pair. These holes are then countersunk with a 100 degree, 0.385 inch diameter countersink and a 100 degree flathead stainless steel 10–32 UNF by 0.75 length screw 64 is installed from the countersink surface. A 10–32 UNF nylock stainless steel nut 66 is used to secure screw 64 on the corresponding non-contact surface 62. All rough surfaces and edges are deburred, whereupon the sectioning process is substantially complete.

Figure 10:
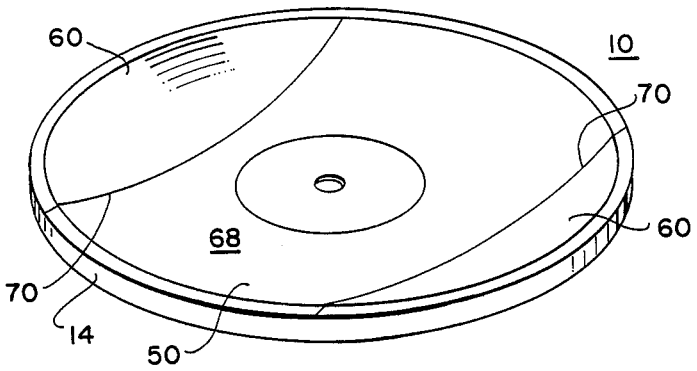
FIG. 10 is a perspective view of the resultant foldable antennae assembly in its deployed position.
Figure 11:
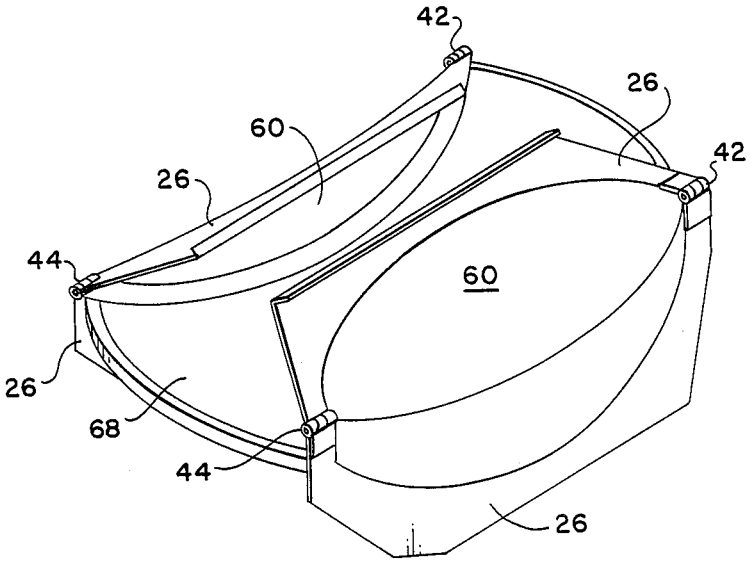
FIG. 11 is a perspective view of the foldable antennae assembly with two sections folded inwardly across the inner surface of the reflector for transport and storage.

Referring to FIGS. 10 and 11, sections 60 are foldable with respect to central portion 68 of reflector 10. As best seen in FIG. 11, one of the beams 26 of each beam pair is connected to the corresponding foldable section 60 and the other beam 26 in the corresponding pair is connected to stationary central portion 68. First and second hinged connections 42 and 44 allow the beams 26 which are connected to the corresponding section 60 to pivot with respect to the corresponding beams 26 which are connected to central portion 68 in such a manner that sections 60 can be folded across inner surface 50 of central portion 68, as shown in FIG. 11. In this configuration reflector 10 is in its "non-deployed" or "stowed" position. In FIG. 10 sections 60 are fully extended when reflector 10 is deployed. The corresponding cutting curves are indicates at 70 in FIG. 10.

The method of sectioning an antennae reflector to provide a foldable reflector assembly in accordance with the present invention maintains the integrity of the reflector surface so that the reflector meets the most stringent performance standards currently imposed on that particular type of reflector. The key to the process is to maintain the reflector in a relaxed state with only its internal residual stresses determining its shape. Thus, the reflective surface is not deformed or otherwise substantially altered in the sectioning process as in prior art processes.

Various embodiments of the invention have now been described in detail. Since it is obvious that many changes in and additions to the above-described preferred embodiment may be made without departing from the nature, spirit and scope of the invention, the invention is not to be limited to said details except as set forth in the appended claims.

What is claimed is:

1. A method of sectioning an antennae reflector, comprising the steps of:

providing a substantially rigid antennae reflector having a curved inner surface for reflecting and focusing electromagnetic energy and a curved outer surface opposite from said inner surface;

providing support means for journally supporting said reflector and positioning said reflector on said support means such that said support means is in contact with a portion of said reflector adjacent to the perimeter thereof and is not in contact with either the curved inner surface or the curved outer surface of the reflector, thereby supporting the reflector in a substantially relaxed state so that only its internal residual stresses determine its shape;

providing 2N number of elongated beams, each of which has relatively flat opposite major surfaces and a minor surface which is curved to conform to the curvature of said outer surface, where N is an integer corresponding to the N number of sections to be formed;

dividing said beams into N number of cooperating pairs and placing each pair in a predetermined position relative to the outer surface so that respective major surfaces of the beams are in facing relationship and the intersection of a plane lying between the facing major surfaces with the outer surface of the reflector defines a corresponding curve along which the reflector is to be sectioned;

identifying said corresponding curves;

connecting the individual beams of each cooperating pair;

securing each beam pair to the outer surface of the reflector so that a spacing is maintained between the respective minor surfaces of the beams and the outer surface of the reflector; and sectioning the reflector along each of the corresponding curves to form said N number of sections.

2. The method according to claim 1 wherein the step of connecting the individual beams of each cooperating pair includes hingedly attaching the individual beams so that the beams of each cooperating pair are pivotally moveable with respect to one another.

3. The method according to claim 2 wherein the hinged attachment between the individual beams in each cooperating pair allows the corresponding section to be folded relative to the remainder of the reflector.

4. The method according to claim 1 wherein said step of supporting the reflector in a substantially relaxed state is comprised of the sub-steps of:

disposing a plurality of support members at predetermined intervals along the circumference of a circle of predetermined diameter;

placing the reflector on the support members with its inner surface face down so that the weight of the reflector is substantially evenly distributed around the perimeter of the reflector; and securing the reflector against vertical and horizontal movement.

5. The method according to claim 4 wherein said reflector has a relatively flat lip member which circumscribes the inner and outer surfaces to define the perimeter thereof, said sub-step of placing the reflector on the support members including placing the reflector so that said lip member is in contact with the support members to prevent the support members from imparting point loading on the curved inner and outer surfaces.

6. The method according to claim 1 wherein said step of identifying the corresponding curves includes the substeps of drilling relatively small holes through the reflector starting at the outer surface and terminating at the inner surface at predetermined intervals along the corresponding curves and drawing connecting lines between adjacent holes on the inner surface to define a series of cutting lines on the inner surface of the reflector.

7. The method according to claim 1 wherein the step of securing each beam pair to the outer surface of the reflector is comprised of the following sub-steps:

providing a plurality of brace members, each of which is comprised of relatively flat first and second plates disposed at a predetermined angle so that the first plate can be placed in facing contact with a major surface of a corresponding beam pair and the second plate can be placed in tangential contact with the outer surface of the reflector adjacent to the corresponding beam pair;

arranging said brace members at predetermined intervals along substantially the entire length of each beam pair so that the respective first plates are in facing contact with non-facing major surfaces on opposite sides of each beam pair and the respective second plates are in tangential contact with the outer surface of the reflector; and securing the brace members so that the respective first plates are attached to the non-facing major surfaces on opposite sides of each beam pair and the respective second plates are attached to the outer surface of the reflector.

8. The method according to claim 7 further including the steps of:

drilling respective first holes at the approximate geometric center of the second plate of each brace member, through the second plate and the outer and inner surfaces of the reflector;

inserting a first attachment member through each of the first holes and securing each first attachment member on the inner and outer surfaces of the reflector;

drilling respective second holes at the approximate geometric center of the first plate of each base member, through the first plate and the abutting beam; and inserting a second attachment member through each of the second holes and securing each second attachment member on the first plate and the abutting beam.

9. The method according to claim 1 further including the steps of removing the beams from their respective predetermined positions prior to the step of identifying said corresponding curves and replacing the beams in their respective predetermined positions prior to the step of securing each beam pair to the outer surface of the reflector.

10. An antennae reflector having a curved inner surface for reflecting and focusing electromagnetic energy and a curved outer surface opposite from said inner surface, said reflector being comprised of a central portion and N number of sections which are moveable relative to said central portion, said N number of sections being formed by journally supporting the reflector along a portion of the reflector adjacent to the perimeter thereof such that a force imparted to the reflector by the journal support thereof does not act on either the curved inner surface or the curved outer surface of the reflector, thereby supporting the reflector in a substantially relaxed state with only its internal residual stresses determining its shape; identifying N number of curves on one of the surfaces of the reflector corresponding to the curves along which the reflector is to be sectioned; connecting respective portions of the reflector on opposite sides of each curve; and sectioning the reflector along each curve to define said N number of sections.

11. The reflector according to claim 10 further including 2N number of elongated beams, each of which has relatively flat opposite major surfaces and a minor surface which is curved to conform to the curvature of the outer surface, said beams being arranged in N number of cooperating pairs which are connected to the outer surface of the reflector by positioning the cooperating pairs in respective predetermined positions relative to the outer surface so that respective major surfaces of the individual beams of each cooperating pair are in facing relationship and the intersection of a plane lying between the facing major surfaces of each pair with the outer surface defines a corresponding curve along which the reflector is to be sectioned, attaching the individual beams of each cooperating pair together so that the individual beams of each cooperating pair are moveable with respect to one another and securing the individual beams of each cooperating pair to respective portions of the outer surface of the reflector on respective opposite sides of the corresponding curve so that one of the beams in each cooperating pair is attached to the central portion of the reflector and the other beam in each cooperating pair is attached to the portion of the reflector which forms the corresponding section.

12. The reflector according to claim 11 further including a relatively flat lip member which circumscribes the inner and outer surfaces of the reflector to define the perimeter thereof, said reflector being supported in a substantially relaxed state by disposing a plurality of support members at predetermined intervals along the circumference of a circle of predetermined diameter, placing the reflector with its inner surface face down so that the lip member is in contact with said plurality of support members to substantially distribute the weight of the reflector around the lip member and securing the reflector against vertical and horizontal movement.

13. The reflector according to claim 11 wherein each of said beams has first and second relatively flat minor surfaces disposed on opposite ends of said curved minor surface and first and second relatively flat extension portions at respective distal ends of the beam.

14. The reflector according to claim 13 wherein each beam pair is placed in its corresponding predetermined position with respect to the reflector by disposing the first and second relatively flat minor surfaces of each beam in contact with the lip member so that each beam is supported by the lip member and the curved minor surface of each beam is in facing relationship with the outer surface of the reflector with space therebetween.

15. The reflector according to claim 14 wherein the first and second extension portions of each beam extend beyond the lip member and the beams of each cooperating pair are hingedly connected by hingedly attaching the respective first extension portions of the beam pair to define a first hinged attachment and the respective second extension portions of the beam pair to define a second hinged attachment.

16. The reflector according to claim 11 wherein said beam pairs are secured to the outer surface of the reflector by:

providing a plurality of brace members, each of which is comprised of first and second relatively flat plates disposed at a predetermined angle;

arranging said brace members at predetermined intervals along substantially the entire length of each beam pair so that the respective first plates are in facing contact with respect to non-facing major surfaces on opposite sides of each beam pair and the respective second plates are in tangential contact with the outer surface of the reflector; and securing the brace members so that the respective first plates are bonded to the respective non-facing major surfaces on opposite sides of each beam pair and the respective second plates are bonded to the outer surface of the reflector.

17. A method of sectioning an antennae reflector having a curved inner surface for reflecting and focusing electromagnetic energy and a curved outer surface opposite from said inner surface, said method comprising the steps of:

journally supporting the reflector along a portion of the reflector adjacent to the perimeter thereof such that a force imparted to the reflector by the journal support thereof does not act upon the curved inner and outer surfaces of the reflector, thereby supporting the reflector in a substantially relaxed state with only its internal residual stresses determining its shape;

identifying N number of curves on one of the surfaces of the reflector, where N is an integer corresponding to the number of sections to be formed from the reflector, to define the corresponding curves along which the reflector is to be sectioned;

connecting respective portions of the reflector on opposite sides of each of said curves; and sectioning the reflector along each of the corresponding curves to divide the reflector into a central portion and N number of sections which are moveable relative to said central portion.

* * * * *